US006198440B1

(12) United States Patent
Ha et al.

(10) Patent No.: US 6,198,440 B1
(45) Date of Patent: Mar. 6, 2001

(54) DUAL BAND ANTENNA FOR RADIO TERMINAL

(75) Inventors: Dong-In Ha, Seoul; Ho-Soo Seo, Kyonggi-do; Seong-Joong Kim, Kyonggi-do; Alexandre Goudelev, Kyonggi-do; Konstantin Krylov, Kyonggi-do, all of (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/251,899

(22) Filed: Feb. 19, 1999

(30) Foreign Application Priority Data

Feb. 20, 1998 (KR) ..... 98-5441

(51) Int. Cl.[7] ..... H01Q 1/24; H01Q 1/36

(52) U.S. Cl. ..... 343/702; 343/895; 343/725; 343/729

(58) Field of Search ..... 343/702, 895, 343/725, 729; H01Q 1/36, 1/24

(56) References Cited

U.S. PATENT DOCUMENTS

| | | | |
|---|---|---|---|
| 4,410,893 | 10/1983 | Griffee | 343/792 |
| 4,571,595 | 2/1986 | Phillips et al. | 343/745 |
| 4,623,894 | 11/1986 | Lee et al. | 343/700 |
| 4,740,795 | 4/1988 | Seavey | 343/786 |
| 5,109,232 | 4/1992 | Monte | 343/785 |
| 5,258,768 | 11/1993 | Smith | 343/786 |
| 5,446,469 | 8/1995 | Makino | 343/702 |
| 5,451,969 | 9/1995 | Toth et al. | 343/781 |
| 5,479,178 | 12/1995 | Ha | 343/702 |
| 5,543,808 | 8/1996 | Feigenbaum et al. | 343/727 |
| 5,583,519 | 12/1996 | Koike | 343/702 |
| 5,594,457 | 1/1997 | Wingo | 343/702 |
| 5,661,496 | 8/1997 | Baek et al. | 343/702 |
| 5,691,730 | 11/1997 | Egashira et al. | 343/702 |
| 5,717,409 | 2/1998 | Garner et al. | 343/702 |
| 5,764,191 * | 6/1998 | Tsuda | 343/702 |
| 5,812,097 | 9/1998 | Maldonado | 343/790 |
| 5,818,392 | 10/1998 | Oka et al. | 343/702 |
| 5,825,330 | 10/1998 | Na et al. | 343/702 |
| 5,835,065 | 11/1998 | Wallace et al. | 343/702 |
| 5,859,617 | 1/1999 | Fujikawa | 343/702 |
| 5,861,859 | 1/1999 | Kanayama et al. | 343/895 |
| 5,892,480 * | 4/1999 | Killen | 343/895 |
| 6,016,130 * | 1/2000 | Annamaa | 343/895 |

* cited by examiner

*Primary Examiner*—Don Wong
*Assistant Examiner*—Hoang Nguyen
(74) *Attorney, Agent, or Firm*—Dilworth & Barrese, LLP

(57) ABSTRACT

A dual band antenna for a radio terminal consists of a retractable whip antenna and a helical antenna with irregular pitches, wherein the whip antenna is independent of the helical antenna. The helical antenna includes first and second helical portions having first and second pitches, respectively and the first and second helical portions are operable at different frequency bands independently. The whip antenna includes a conductive core line, a conductive substance covering a first portion of the conductive core line to serve as a choke and an isolation element extending from an upper end of the conductive core line, for filling a gap between the conductive core line and the conductive substance. Here, only the first portion of the conductive core line is operable at a first frequency band and the entire conductive core line is operable at a second frequency. A fixing element fixes the helical antenna and the whip antenna to the radio terminal. The fixing element has an upper end connected to a lower end of the helical antenna and a through hold via which the whip antenna is inserted into an interior of the radio terminal.

29 Claims, 20 Drawing Sheets

OVERLAYS

FREQUENCY: 0.824 GHz ----
FREQUENCY: 0.836 GHz ----
FREQUENCY: 0.849 GHz ----
FREQUENCY: 0.869 GHz ----
FREQUENCY: 0.881 GHz ----
FREQUENCY: 0.894 GHz ----

OVERLAYS

FREQUENCY: 1.850 GHz ----
FREQUENCY: 1.880 GHz ----
FREQUENCY: 1.910 GHz ----
FREQUENCY: 1.930 GHz ----
FREQUENCY: 1.960 GHz ----
FREQUENCY: 1.990 GHz ----

DUAL BAND ANTENNA FOR RADIO TERMINAL

BACKGROUND OF THE INVENTION

1. Field of the Invention

The present invention relates to a dual band antenna for a radio terminal capable of efficient operation at two different frequency bands.

2. Description of the Related Art

In general, to implement a dual band antenna using a single antenna, an additional element such as a choke is required for enabling respective parts of the antenna to independently operate at different frequencies. U.S. Pat. Nos. 3,139,620 and 4,509,056 disclose an antenna employing a choke, to permit operation at multiple frequencies.

U.S. Pat. No. 4,509,056 (the '056 patent) discloses a multi-frequency antenna employing tuned sleeve chokes. FIG. 1 of the '056 patent illustrates a cross sectional view of a monopole antenna operating at dual frequencies. This antenna is suitable for a radio terminal in which the frequency is not isolated by harmonics and the frequency ratio is greater than 1.25. As illustrated, the antenna is composed of a common monopole antenna, a coaxial transmission line having an open end, a shorted end, and a ground plane.

In FIG. 1, a coaxial transmission line choke 12*i* is formed at the middle of the antenna and has an electrical length $\lambda/4$ at the higher frequency band of the dual frequency band. At the higher frequency band, the $\lambda/4$ sleeve choke 12*i* forms a very high impedance between the open end and an extension element 100 of the coaxial feed line, thereby preventing coupling therebetween. Accordingly, at the higher frequency band, only the portion represented by l functions as the antenna as illustrated in FIG. 1. However, at the lower frequency band, the sleeve choke 12*i* does not serve as an isolation element so that the entire portion represented by P functions as a monopole antenna.

A drawback associated with the conventional dual band antenna employing a choke is that it is both complicated and large, as compared with a single band antenna. Further, the large antenna may be easily damaged by a trivial impact. In addition, the conventional fixed (i.e., irretractable) antenna may inconvenience a user in carrying the radio terminal.

SUMMARY OF THE INVENTION

It is therefore an object of the present invention to provide a dual band antenna for a radio terminal, consisting of a retractable whip antenna and a helical antenna with irregular pitches, wherein the whip antenna is independent of the helical antenna.

To achieve the above object, there is provided a dual band antenna for a radio terminal, including a helical antenna having first and second helical portions having first and second pitches. The first and second helical portions being independently operable at different frequency bands. The dual band antenna further includes a whip antenna including a conductive core line, a conductive substance covering a first portion of the conductive core line to serve as a choke and an isolation element extending from an upper end of the conductive core line, for filling a gap between the conductive core line and the conductive substance, Wherein only the first portion of the conductive core line is operable at a first frequency band and the entire conductive core line is operable at a second frequency; and a fixing element for fixing the helical antenna and the whip antenna to the radio terminal, wherein the fixing element has an upper end connected to a lower end of the helical antenna and a through hole via which the whip antenna is inserted into an interior of the radio terminal. Here, the first pitch of the first helical portion is narrower than the second pitch of the second helical portion.

A feature of the present invention is that when the whip antenna is retracted into the radio terminal, only the helical antenna is operable and the isolation element of the whip antenna is located in the through hole of the fixing element, so as to decouple the whip antenna from the helical antenna.

A ratio of the first frequency band to the second frequency band is controlled by adjusting the number of turns of a coil constituting the helical antenna, while the first and second pitches of the first and second helical portions are fixed to specified values.

Further, the fixing element has screwed teeth formed at a lower, outer wall for fixing the fixing element to the radio terminal.

BRIEF DESCRIPTION OF THE DRAWINGS

The above and other objects, features and advantages of the present invention will become more apparent from the following detailed description when taken in conjunction With the accompanying drawings in which like reference numerals indicate like parts. In the drawings.

DETAILED DESCRIPTION OF THE PREFERRED EMBODIMENT

A preferred embodiment of the present invention will be described hereinbelow with reference to the accompanying drawings. In the following description, well known functions or constrictions are not described in detail since they would obscure the invention in unnecessary detail.

A dual band antenna constructed in accordance with the present invention will be described comprising a whip antenna and a helical antenna, wherein the whip antenna is retractable into a radio terminal.

In a retracted state (See FIGS. 3 and 17), the whip antenna is completely retracted into the radio terminal and only the relatively short helical antenna is protruded on the radio terminal. In this state, only the helical antenna is operable. Therefore, in the retracted state, the overall length of the radio terminal becomes short, providing a good external appearance. Further, the whip antenna is protected from external impact. The Whip antenna used in the present invention comprises two separate embodiments.

In a first embodiment, the whip antenna employs a choke structure which is widely used for dual band antennas. The choke structure of the whip antenna is comprised of a conductive substance covering a conductive core line (See FIG. 2). In a second embodiment, the whip antenna uses a simple matching circuit instead of the choke, to implement the dual band antenna (See FIG. 12).

With reference to the retracted state of the antenna, only the helical antenna portion of the dual-band antenna is operational. That is, the whip antenna is non-functional in the retracted state. Unlike the conventional dual band antenna, this helical antenna can operate independently at two different frequencies by simply adjusting the pitches of a helical coil without using an additional frequency isolation element. Such capability permits the dual band antenna of the present invention to be small in size and simple in structure.

Figure 2:
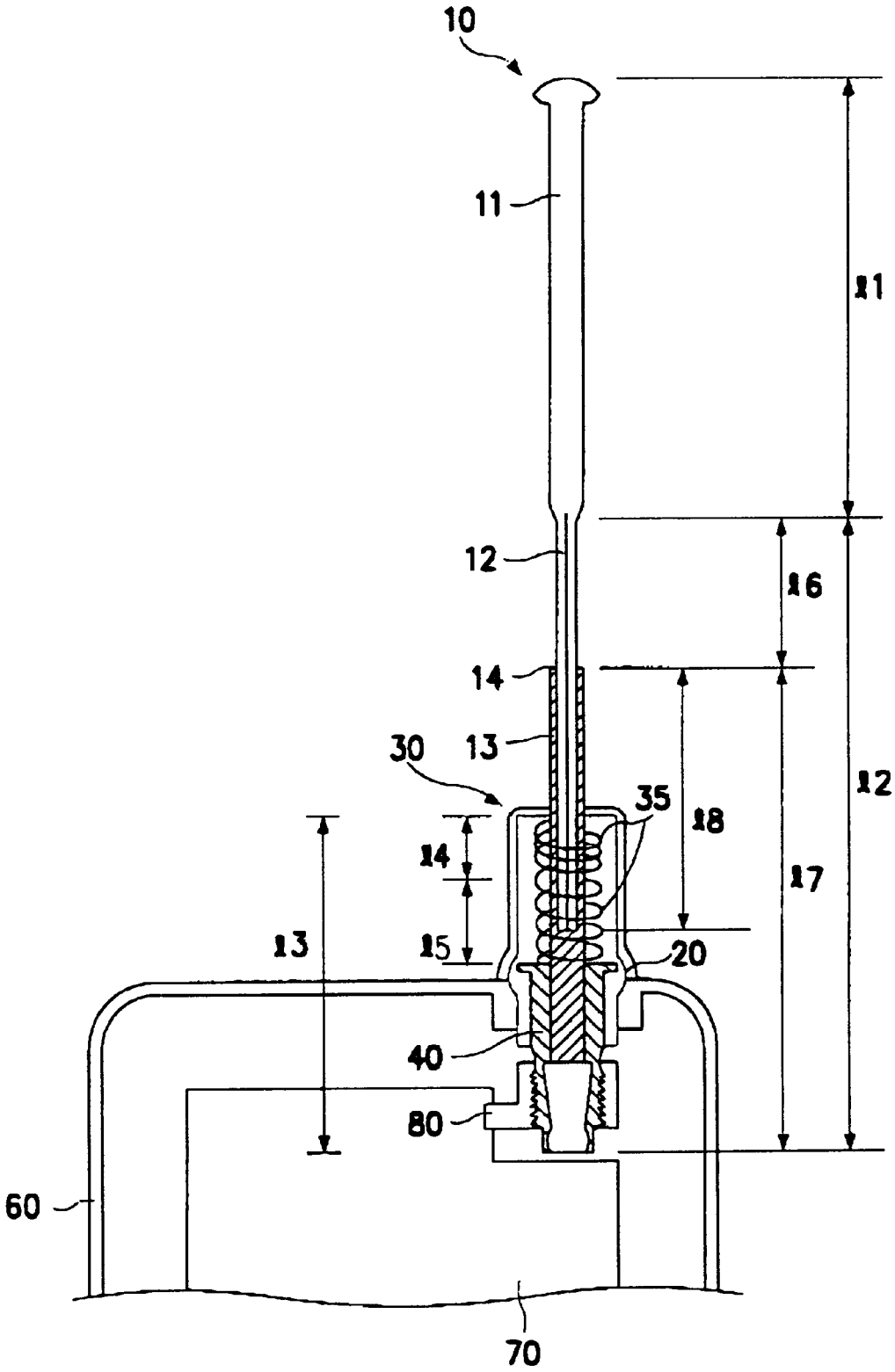
FIG. 2 is a cross sectional view illustrating a dual band antenna consisting of a retractable whip antenna extended from a radio terminal and a helical antenna according to an embodiment of the present invention.

FIG. 2 illustrates the dual band antenna assembled in a radio terminal (e.g., mobile telephone), wherein a retractable whip antenna 10 is extended from the radio terminal to extend an effective electrical length of the antenna, thereby improving a radiation characteristic. The whip antenna 10 is composed of a conductive core line 12, a conductive substance 13 covering a first portion of the conductive core line 12 to serve as a choke, and an isolation element 11 for filling a gap between the conductive core line 12 and the conductive substance 13. The isolation element 11 extends from an upper end of the conductive core line 12 to a specified extent. In the whip antenna 10, only the first portion of the conductive core line 12 serves as the antenna at one frequency band and the entire conductive core line 12 serves as the antenna at another frequency band.

A helical antenna 30 is composed of first and second helical portions l4 and l5 having different pitches, formed by winding a coil 35, and an isolation tube 20 for protecting the first and second helical portions l4 and l5. With this structure, the helical antenna 30 can operate at two independent frequency bands by simply adjusting the pitches of the coil 35 instead of using the additional frequency isolation element, with a conventional dual band antenna. A metal fixing element 40 fixes the whip antenna 10 and the helical antenna 30 to a chassis 60 of the radio terminal. A lower end of the coil 35 constituting the helical antenna 30 is connected to an tipper end of the metal fixing element 40. The fixing element 40 has a through hole so that the whip antenna 10 may be inserted into the interior of the radio terminal via the through hole. Further, a lower end of the fixing element 40 is connected to a printed circuit board (PCB) 70 via a feed point 80 for connecting the antenna to a signal source. In addition, the fixing element 40 has screwed teeth formed at a lower, outer wall thereof. The screwed teeth serve to connect the lower end of the helical antenna 30 with the body of the radio terminal.

In FIG. 2, reference l1 denotes a length of a portion of the isolation element 11, in which the conductive core line 12 does not exist. Reference l3 denotes a physical length of the helical antenna 30 including the fixing element 40. Reference l7 denotes a length of the whip antenna 10, which serves as the antenna at the higher frequency band of the dual frequency bands. Reference l2 denotes a length of the conductive core line 12 of the whip antenna 10. References l5 and l4 denote physical lengths of the second and first helical portions of the helical antenna 30 having different pitches, respectively, wherein the first helical portion l4 has the narrower pitch than that of the second helical portion l5. Reference l6 denotes a length of a portion of the conductive core line 12, which is not covered with the conductive substance 13. Reference l8 denotes a length of the first portion of the conductive core line 12, which is covered with the conductive substance 13 to form the choke on the whip antenna 10 and has a length $\lambda/4$ at the higher frequency.

Figure 3:
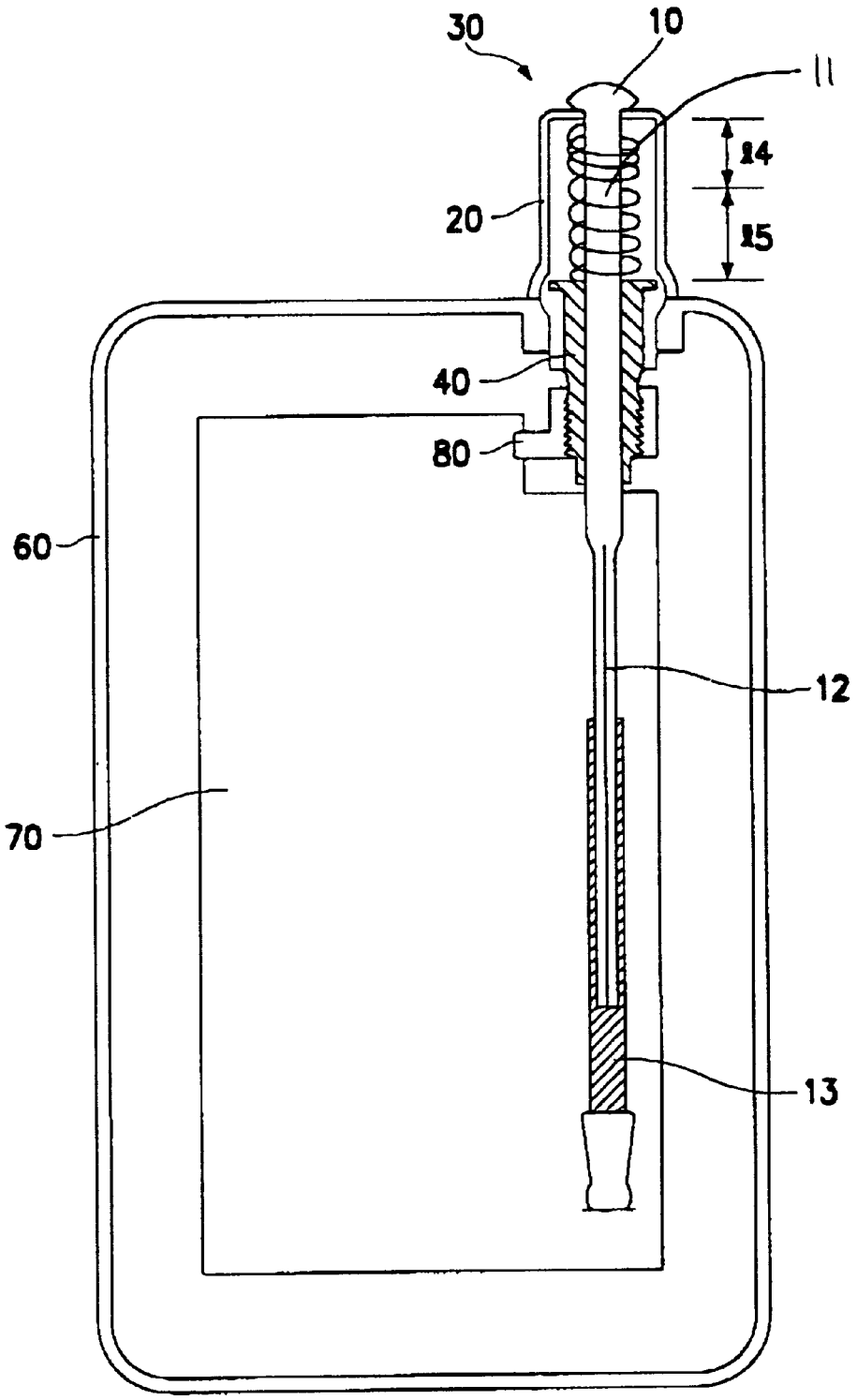
FIG. 3 is a cross sectional view illustrating the dual band antenna consisting of the retractable whip antenna retracted into a radio terminal and the helical antenna according to an embodiment of the present invention.

FIG. 3 illustrates the dual band antenna assembled in the radio terminal, wherein the whip antenna 10 is retracted into the radio terminal. The whip antenna 10 is shown completely retracted into the chassis 60 of the radio terminal, while the helical antenna 30 protrudes from the chassis 60. The helical antenna 30 fixed to the chassis 60 is much shorter than the whip antenna 10. When the whip antenna 10 is retracted, only the helical antenna 30 is operable.

Figure 4A:
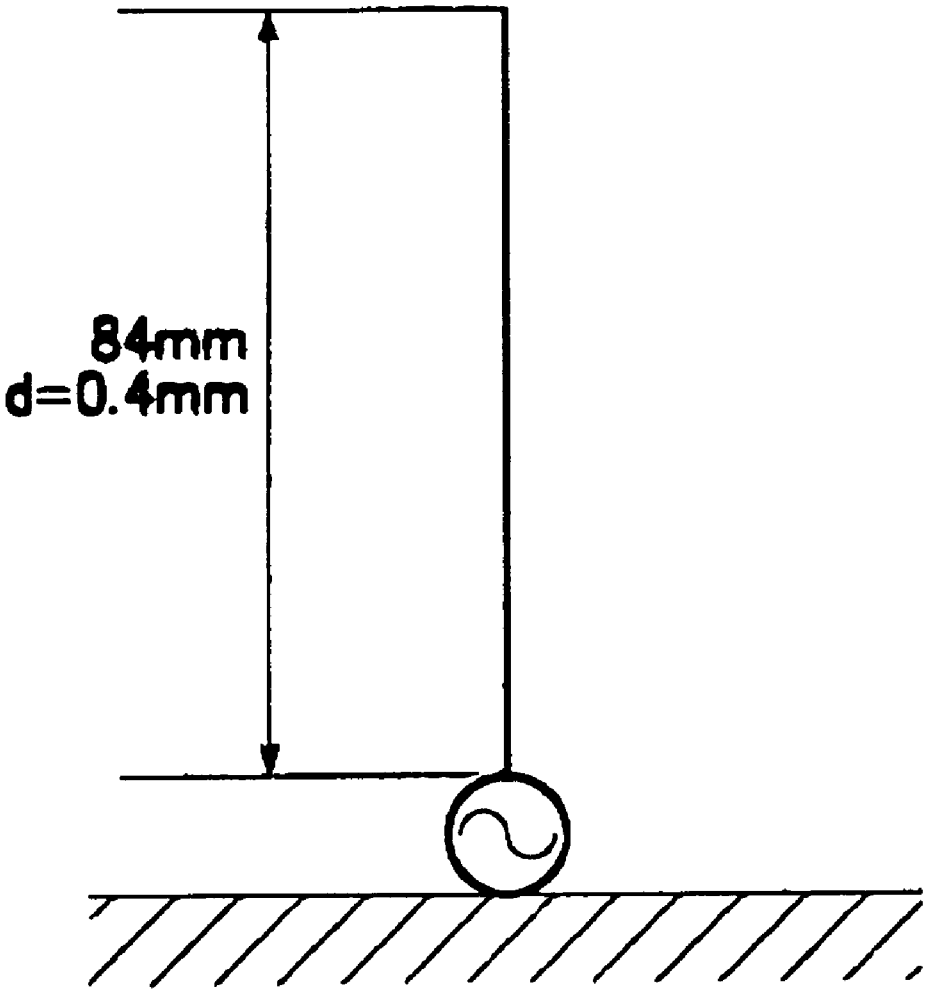
FIG. 4A is a diagram depicting a whip antenna to illustrate a periodic characteristic of the resonant frequency.
Figure 4B:
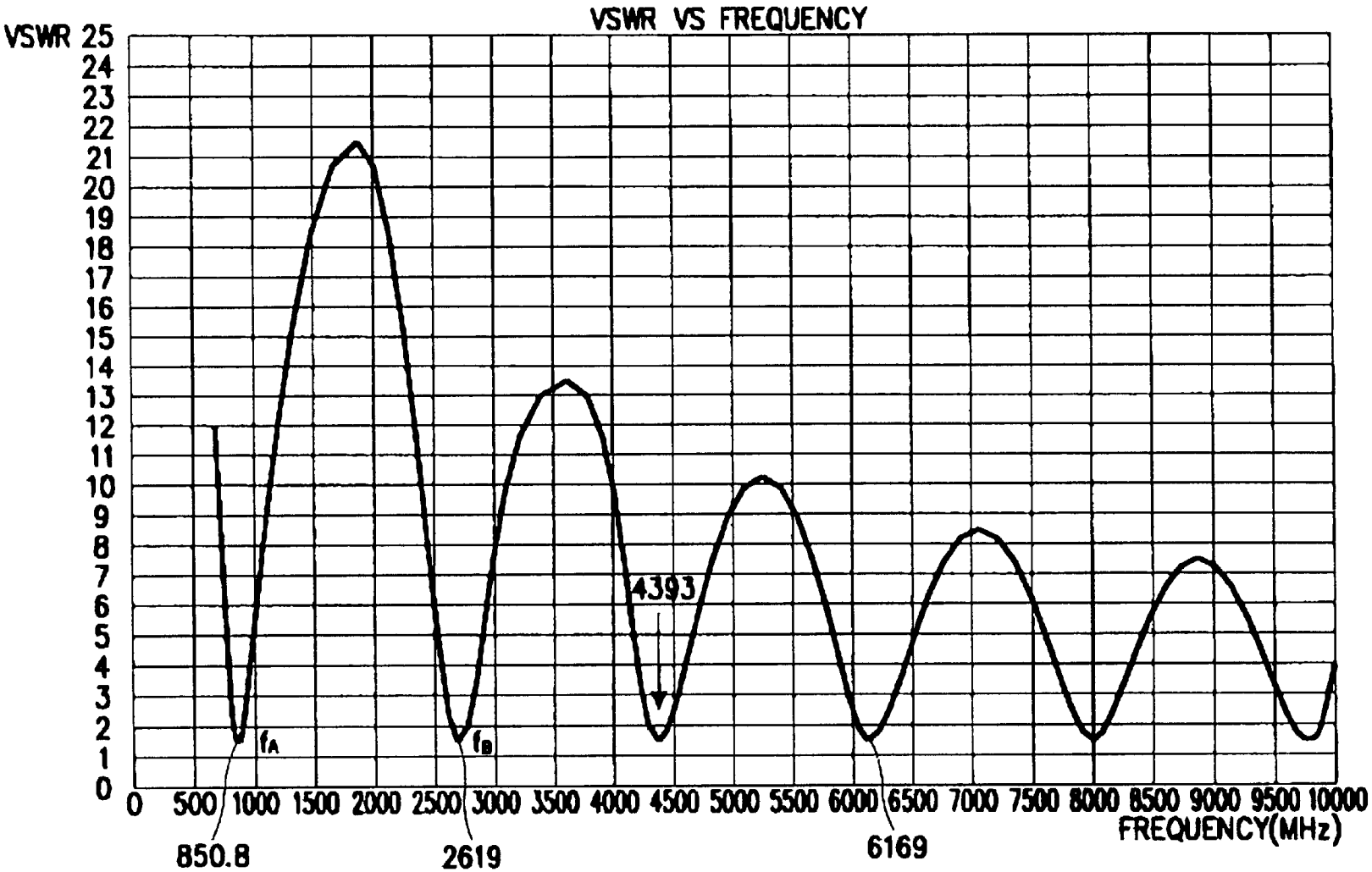
FIG. 4B is a diagram illustrating an impedance characteristic (VSWR) vs. frequency of the whip antenna shown in FIG. 4A.

FIG. 4A illustrates a simplified whip antenna to illustrate a periodic characteristic of the resonant frequency. Specifically, FIG. 4A illustrates a whip antenna which does not include a choke. FIG. 4B illustrates an impedance characteristic of the whip antenna shown in FIG. 4A.

Figure 1:
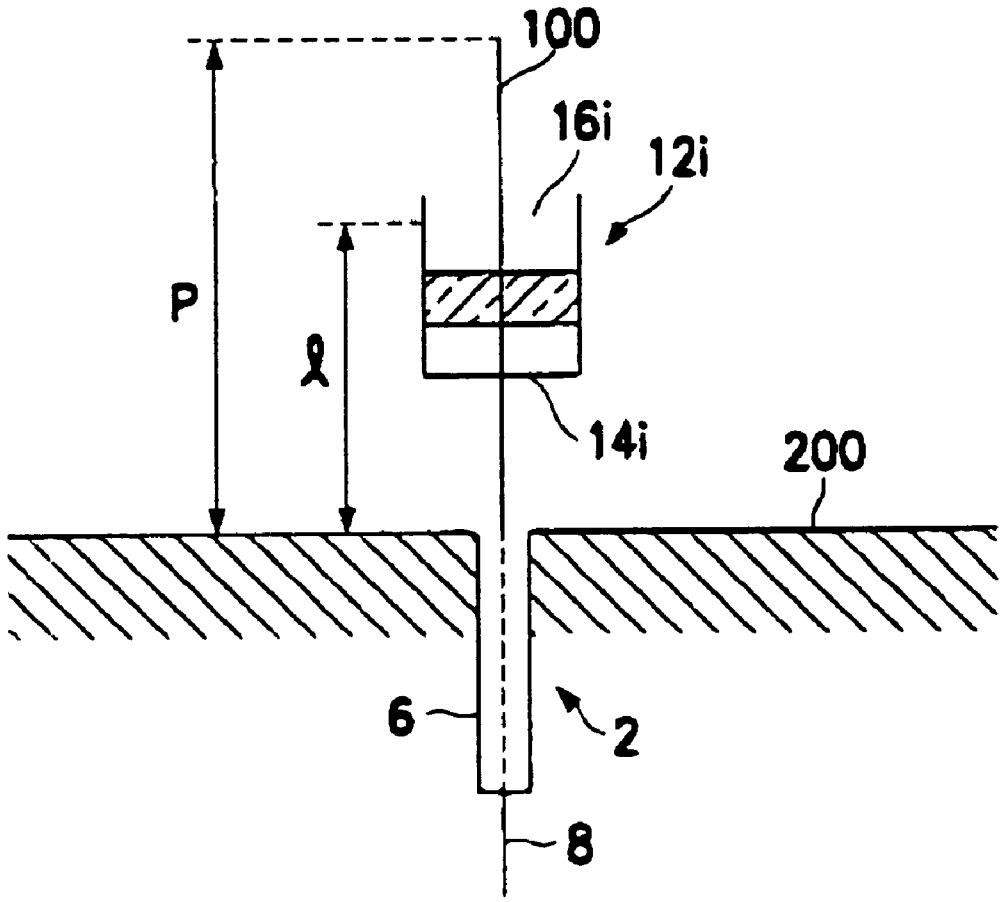
FIG. 1 is a cross sectional view illustrating a monopole antenna capable of operating at dual frequencies in accordance with the prior art.

In FIG. 4B, a frequency ratio $f_A/f_B$ at points A and B having the lowest resonant frequencies is 3:1. It is important to note that points A and B, having the lowest resonant frequencies, are the points at which the optimal radiation pattern may be obtained. If the radio terminal operates at an exact frequency ratio $f_A/f_B$ of 3:1, it is possible to easily implement the dial band antenna using the characteristic shown in FIG. 4B. However, it is very rare that the dual band antenna will operate exactly at the correct frequency ratio $f_A/f_B$ of 3:1. Therefore, it is impossible to apply this characteristic to the dual band antenna having an unspecified frequency ratio. In the prior art embodiment, illustrated in FIG. 1, a choke is formed at a specified position of the antenna in order to construct an antenna having a resonant characteristic at a desired frequency ratio. To prevent a lowering of the radiation efficiency, the frequency ratio of the two resonant frequencies of the dual band antenna may be adjusted using the choke formed at the middle of the antenna, as shown in FIG. 1. In accordance with the teachings of the present invention, the choke is not required. It is possible to obtain a desired frequency ratio without using the choke by only adjusting the pitch and/or the number of turns of the coil 35 constituting the helical antenna 30.

In the dual band antenna shown in FIGS. 2 and 3, the whip antenna 10 is retractable and independent of the helical antenna 30. Now, a detailed description will be provided wherein in an extended state of the antenna only the whip antenna 10 is operable, and in a retracted state of the antenna only the helical antenna 30 is operable.

Extended State of Whip Antenna

Referring again to FIG. 2, the whip antenna 10 is completely extended from the chassis 60 of the radio terminal. In this case, the fixing element 40 is connected to both the whip antenna 10 and the helical antenna 30. However, since the helical antenna 30 is relatively much shorter in physical length than the whip antenna 10 and is in contact with the whip antenna 10, only the whip antenna 10 is operated. Therefore, it is apparent that the dual band antenna is approximately equivalent to the whip antenna 10 when the whip antenna is in the extended state.

Since the helical antenna 30 portion is negligible, the whip antenna 10 and the taxing element 40 are only considered in the extended state of the antenna. Here, the whip antenna 10 can be divided into the conductive core line 12 serving as a radiation substance, the conductive substance 13 and the isolation element 11.

In the preferred embodiment, the choke for the higher frequency band is implemented using a $\lambda/4$ sleeve. The choke is implemented at the portion l8 where the conductive core line 12 is covered with the conductive substance 13. Owing to the choke, at the higher frequency band, the portion l6 of the whip antenna 10 is not operable and only the portion l7 functions as the antenna. In FIG. 2, an impedance seen at a junction 14 of l7 and l6 towards the feed point 80 is defined as $$Z_{choke}=jZ_0 \tan(2\pi/\lambda_H \times l8) \quad (1)$$

where $$Z_0=60/\sqrt{\epsilon_r} \times Ln(b/a) \quad (2)$$

where $Z_{choke}$ is a choke impedance, $\lambda_H$ is a wavelength of the higher frequency out of the dual frequencies, $Z_0$ is a characteristic impedance of the coaxial line, l8 is the length of conductive substance 13 serving as the choke, $\epsilon_r$ is a dielectric constant of the dielectric substance used for the coaxial line, a is a diameter of the conductive core line 12 and b is a diameter of the conductive substance 13.

It is understood from equations (1) and (2) that the choke impedance $Z_{choke}$ is approximiately infinite at the higher frequency band, (i.e., when the length l8 is $\lambda/4$). In this case, the portion l6 of the whip antenna 10 is decoupled from the portion l8 so that only the portion l7 may serve as the antenna at the higher frequency band. On the other hand, at the lower frequency band, the choke impedance $Z_{choke}$ is not high enough to function as an isolation element so that the entire portion l2 of the whip antenna 10 may serve as the antenna.

Retracted State of Whip Antenna

Referring to FIG. 3, when the whip antenna 10 is completely retracted into the chassis 60 of the radio terminal, the isolation element 11 of the whip antenna 10 is positioned in the helical antenna 30 and the upper end of the conductive core line 12 is located below a lower end of the fixing element 40, so that the fixing element 40 is decoupled from the conductive core line 12 of the whip antenna 10. As a result, only the helical antenna 30 can serve as the antenna. In this case, it can be considered that the antenna of the radio terminal consists of the helical antenna 30 and the fixing element 40 for fixing the helical antenna 30.

Figure 5A:
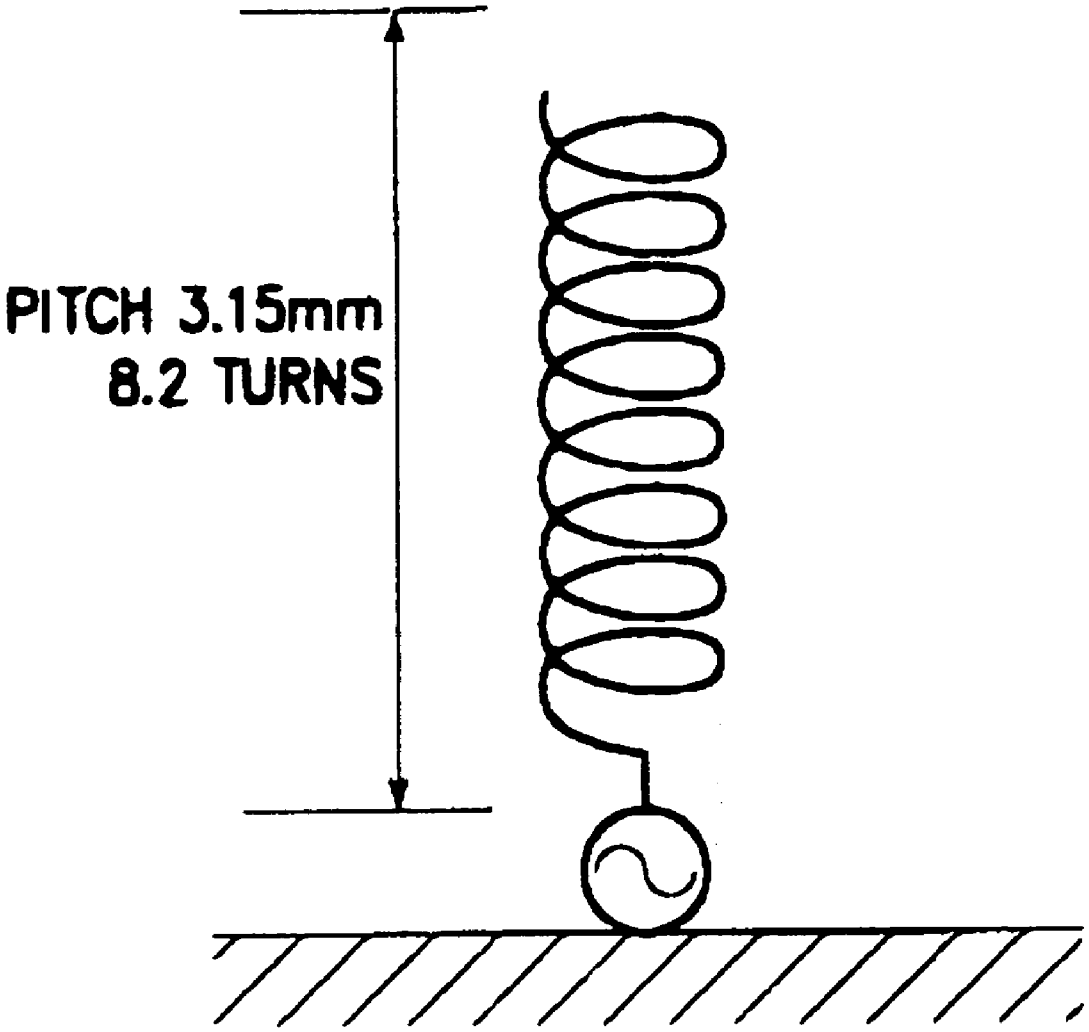
FIG. 5A is a diagram illustrating a common helical antenna with regular pitches in accordance with the prior art.
Figure 5B:
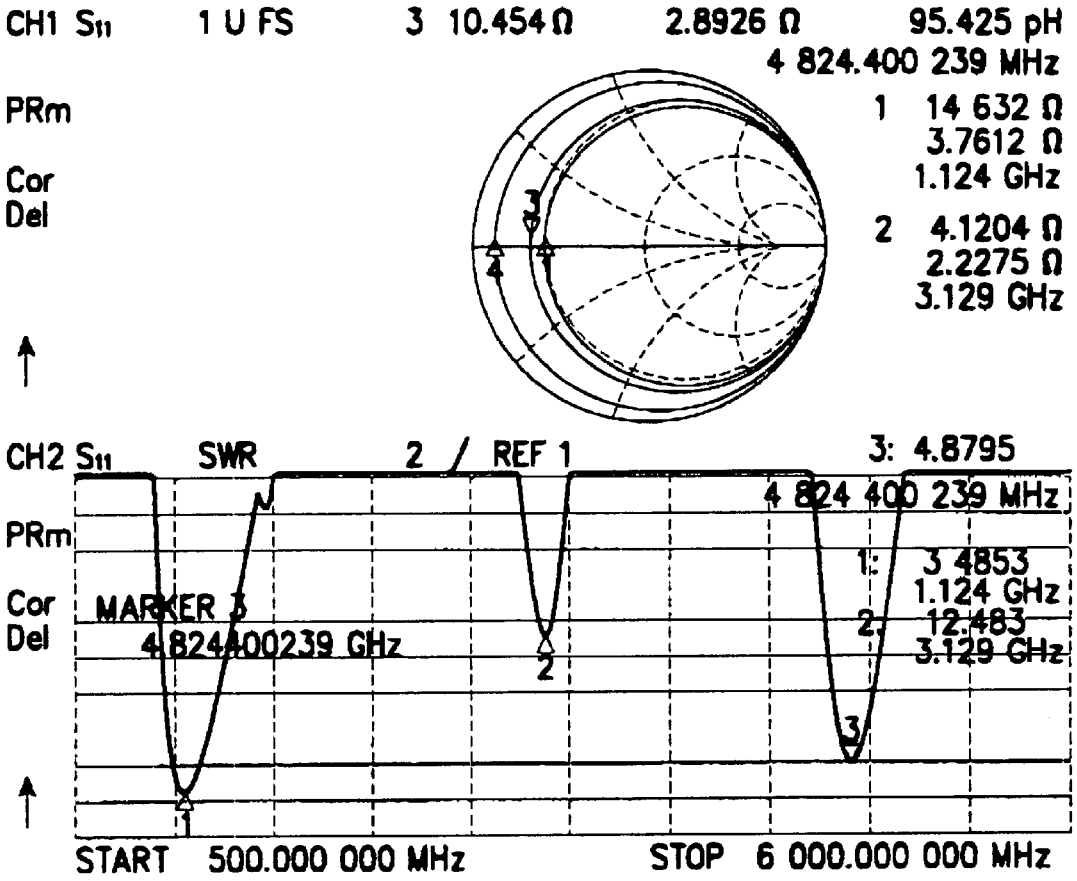
FIG. 5B is a Smith chart showing impedances at a frequency band including two resonant frequencies of the helical antenna shown in FIG. 5A.

FIG. 5A illustrates a prior art helical antenna composed of a coil with a regular pitch, and FIG. 5B is a Smith chart showing the impedances at a frequency band including the two resonant frequency bands of the helical antenna of FIG. 5A. Here, the resonant frequency ratio is about 3:1 and the impedances at the two resonant frequencies are different from each other.

Figure 6A:
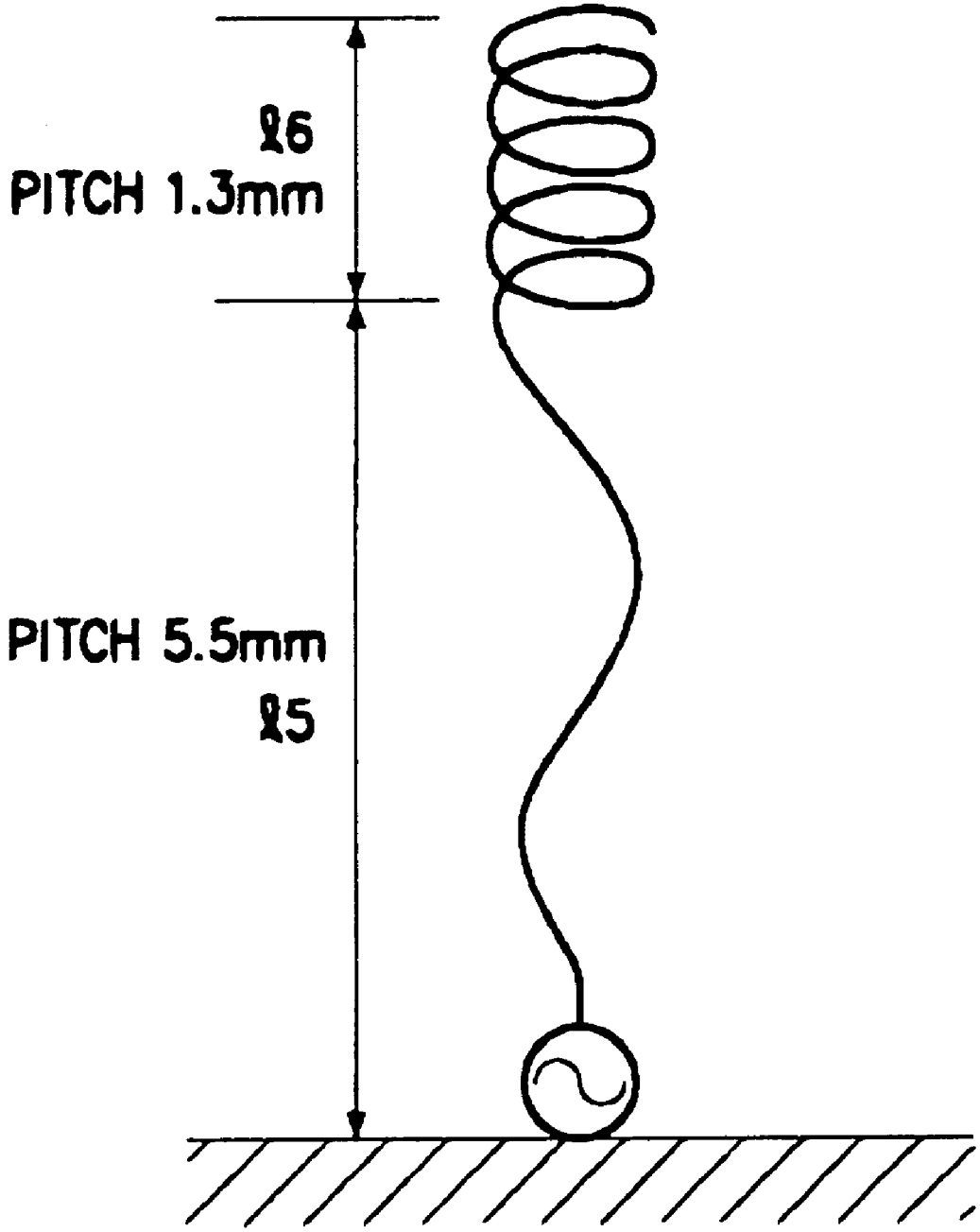
FIG. 6A is a diagram illustrating a helical antenna with irregular pitches according to an embodiment of the present invention.
Figure 6B:
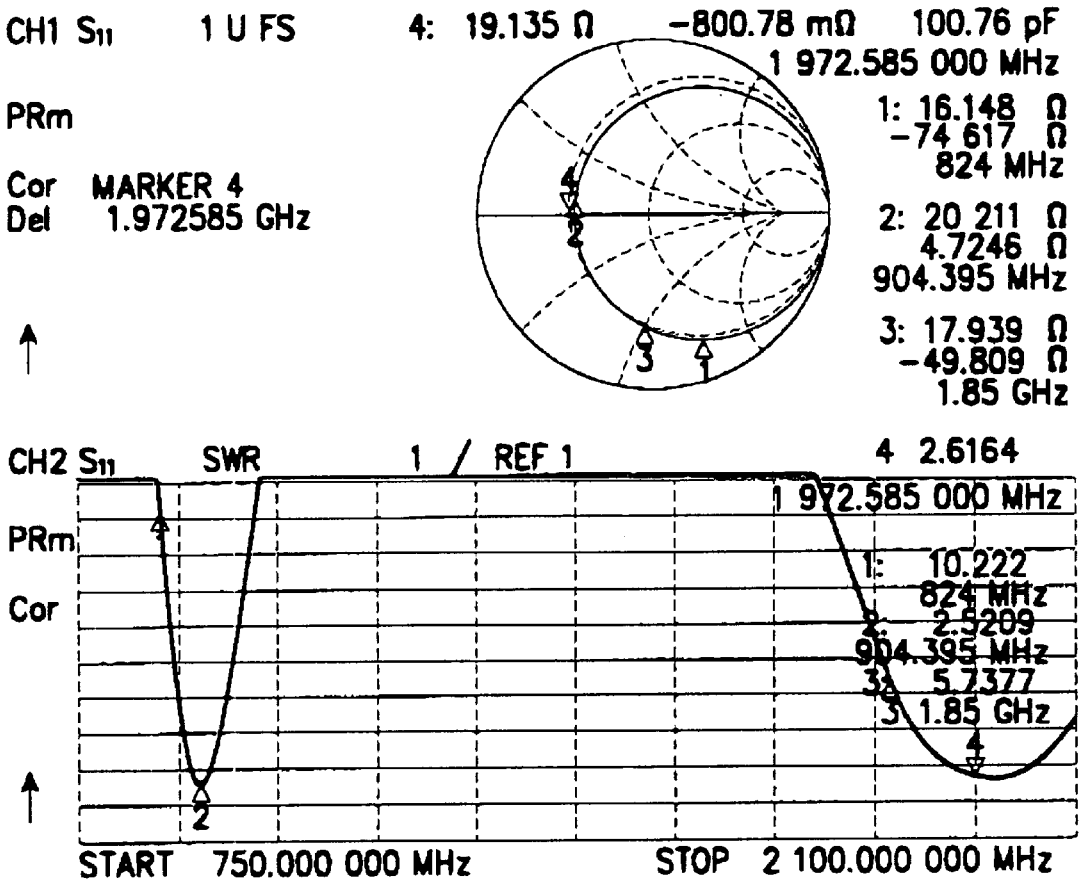
FIG. 6B is a Smith chart showing impedances at a frequency band including two resonant frequencies of the helical antenna shown in FIG. 6A.

FIG. 6A illustrates the novel helical antenna 30 composed of the coil 35 with irregular pitches, and FIG. 6B is a Smith chart showing the impedances at the two resonant frequency bands of the helical antenna 30 of FIG. 6A. Here, the resonant frequency ratio is approximately 2.2:1 and the impedances at the two resonant frequencies are approximately equal.

It is known that an inductance of the coil is inversely proportional to the pitch. The coil 35 constituting the helical antenna 30 has the first helical portion l4 and the second helical portion l5 wherein the pitch of the first helical portion l4 is narrower than that of the second helical portion l5, so that the inductance at the first helical portion l4 is higher than that of the second helical portion l5. Here, the overall inductance of the coil is obtained by $j2\pi fL$. If f and L are high, the overall inductance of the coil 35 increases. Generally, when the inductance increases, a current flowing to the coil decreases. Thus, at a high frequency band, the inductance of the first helical portion L4 is higher than the inductance of the second helical portion L5 and the current flowing to the first helical portion L4 is smaller than the current flowing to the second helical portion L5. Accordingly, at the high frequency band, actually, just the second helical portion L5 functions as an antenna.

Referring to FIG. 6B, the resonant frequencies of the antenna are 1972 MHz and 904 MHz, respectively. Thus, the resonant frequency ratio is approximately 2.2:1. As previously stated, the resonant frequency ratio of the antenna can be controlled by adjusting the pitches of the first and second helical portions l4 and l5. Table 1 shows the two resonant frequencies $f_H$ and $f_L$, and its ratio $f_H/f_L$ as a function of the pitch of the first helical portion l4. Here, it is assumed that the second helical portion l5 has the pitch 4.7 mm and an inner diameter 3.8 mm, and the coil 35 has a diameter 0.4 mm.

TABLE 1

| Pitch of First Helical Portion | | 0.6 | 1.45 | 1.9 | 2.5 |
|---|---|---|---|---|---|
| Resonant Frequency | $f_H$(MHZ) | 2575 | 2810 | 2918 | 2936 |
| | $f_L$(MHZ) | 1237 | 1211 | 1169 | 1124 |
| | $f_H/f_L$ | 2.08 | 2.32 | 2.50 | 2.61 |

Figure 7:
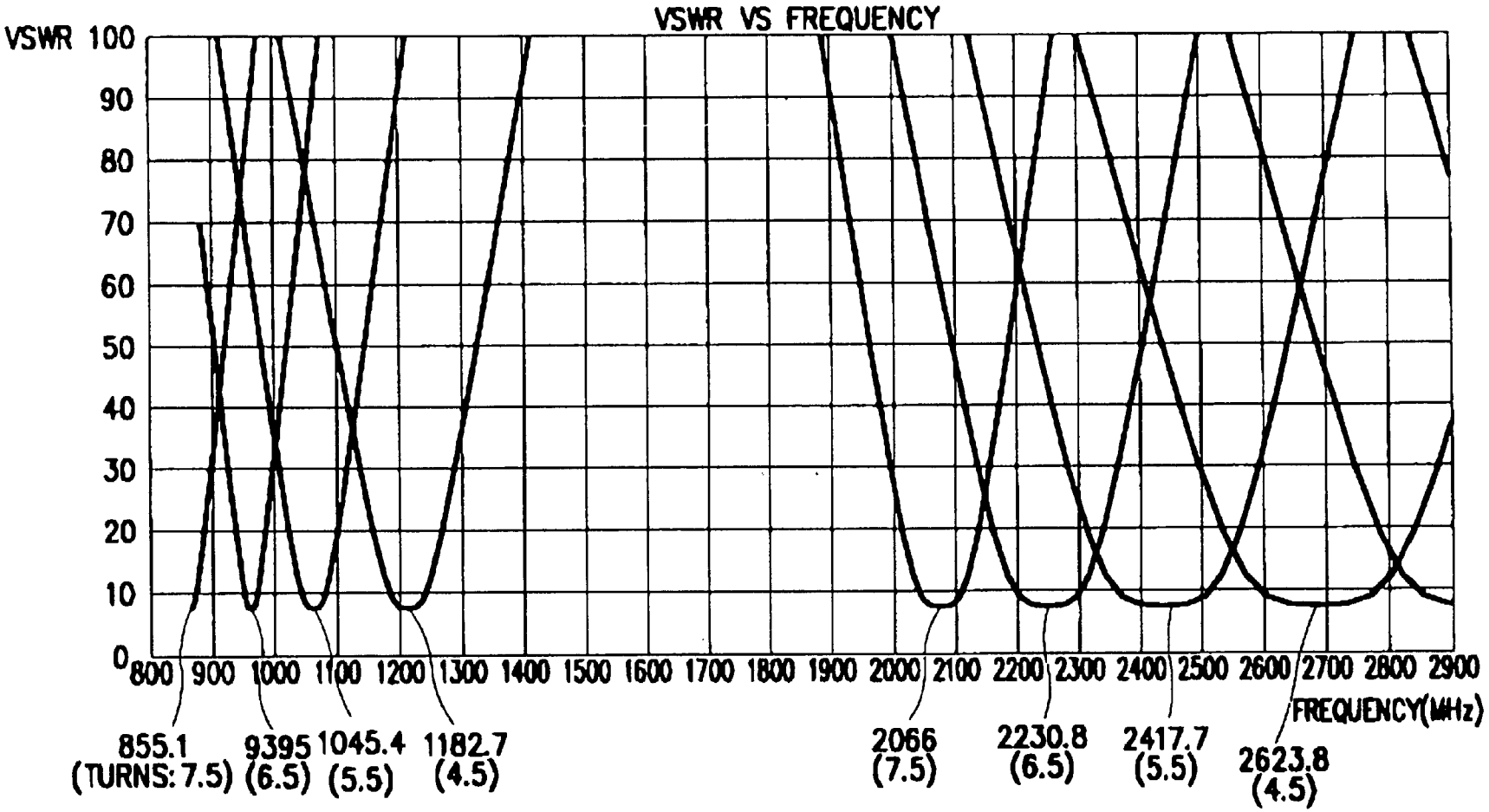
FIG. 7 is a diagram illustrating the impedance characteristic of the helical antenna according to a change in the number of turns of a coil (35) at a first helical portion (16) having a first pitch.

FIG. 7 illustrates the impedance characteristic of the helical antenna 30 according to a change in the number of turns of the coil 35 at the first helical portion l4 having the first pitch.

Table 2 shows the two resonant frequencies $f_H$ and $f_L$, and their ratio $f^H/f_L$ as a function of the pitch of the second helical portion l5. Here, it is assumed that the first helical portion l4 has the pitch 0.6 mm and an inner diameter 3.8 mm, and the coil 35 has a diameter 0.4 mm.

TABLE 2

| Pitch of Second Helical Portion | | 4.7 | 5.7 | 7.6 |
|---|---|---|---|---|
| Resonant Frequency | $f_H$(MHZ) | 2575 | 2522 | 2436 |
| | $f_L$(MHZ) | 1237 | 1233 | 1201 |
| | $f_H/f_L$ | 2.080 | 2.045 | 2.028 |

Figure 8:
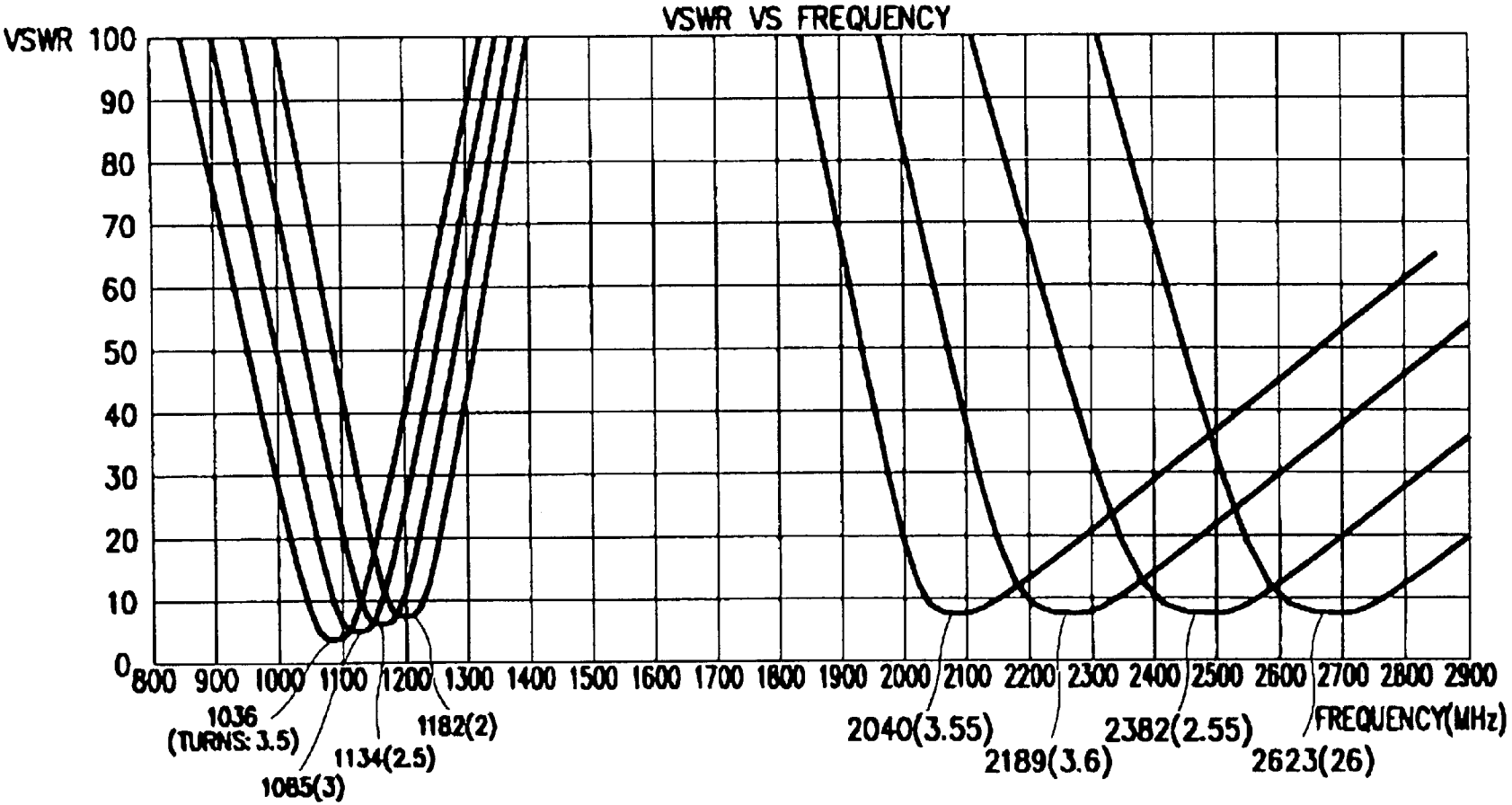
FIG. 8 is a diagram illustrating the impedance characteristic of the helical antanna according to a change in the number of turns of the coil at a second helical portion (15) having a second pitch.

FIG. 8 illustrates the impedance characteristic of the helical antenna according 30 to a change in the number of turns of the coil at the second helical portion 15 having the second pitch.

The resonant frequencies of the antenna, illustrated in Table 3, may also be changed by changing the number of turns of the coil 35 while fixing the pitch to a specified value.

Table 3 shows the two resonant frequencies $f_H$ and $f_L$, and their ratio $f_H/f_L$ according to the number of turns of the coil 35 at the second helical portion l5. Here, it is assumed that the first and second helical portions l4 and l5 have the pitches 1.3 mm and 5.5 mm, respectively and an inner diameter 3.8 mm, and the coil 35 has a diameter 0.4 mm.

TABLE 3

| Turns of Coil at Second Helical Portion | | 2 | 2.5 | 3 | 5 |
|---|---|---|---|---|---|
| Resonant Frequency | $f_H$(MHZ) | 2624 | 2382 | 2190 | 1755 |
| | $f_L$(MHZ) | 1183 | 1134 | 1086 | 899 |
| | $f_H/f_L$ | 2.21 | 2.10 | 2.02 | 1.95 |

Table 4 shows the two resonant frequencies $f_H$ and $f_L$, and their ratio $f^H/f_L$ according to the number of turns of the coil 35 at the first helical portion l4. Here, it is assumed that the first and second helical portions l4 and l5 have the pitches 1.3 mm and 5.5 mm, respectively and an inner diameter 4.6 mm, and the coil 35 has a diameter 0.4 mm.

TABLE 4

| Turns of Coil at First Helical Portion | | 4.5 | 5.5 | 6.5 | 9.5 |
|---|---|---|---|---|---|
| Resonant Frequency | $f_H$(MHZ) | 2624 | 2418 | 2233 | 1790 |
| | $f_L$(MHZ) | 1183 | 1046 | 939 | 729 |
| | $f_H/f_L$ | 2.21 | 2.31 | 2.38 | 2.46 |

It is to be appreciated from Tables 3 and 4 that the resonant frequency ratio decreases (i.e., approaches 1) with increasing number of turns at the second helical portion l5. It is also observed that the resonant frequency increases with increasing number of turns at the first helical portion l4.

Referring to FIG. 6B, the impedance cycles at the two resonant frequencies are approximately equal to each other. Accordingly, in the helical antenna 30, it is possible to adjust the impedances at the two frequency bands to an approximately identical value without a separate matching circuit, even though the ratio of the two frequencies are not exactly 3:1. As a result, it is possible to obtain a desired dual band antenna by adjusting the pitch and the number of turns of the coil 35.

In the embodiment, the helical antenna 30 has the same impedance characteristic as that of the whip antenna 10. That is, if the whip antenna 10 has the impedance characteristic shown in FIG. 7, the helical antenna 30 should also have the same impedance by adjusting the pitch and the number of turns of the coil 35. In this case, the helical antenna 30 is also matched to a matching circuit used for the whip antenna 10.

In the meantime, a helical antenna having a single pitch has a periodic resonant characteristic. However, since this helical antenna has different impedances at the respective frequencies, it is impossible for the helical antenna to have the same impedance as that of the whip antenna.

Figure 9:
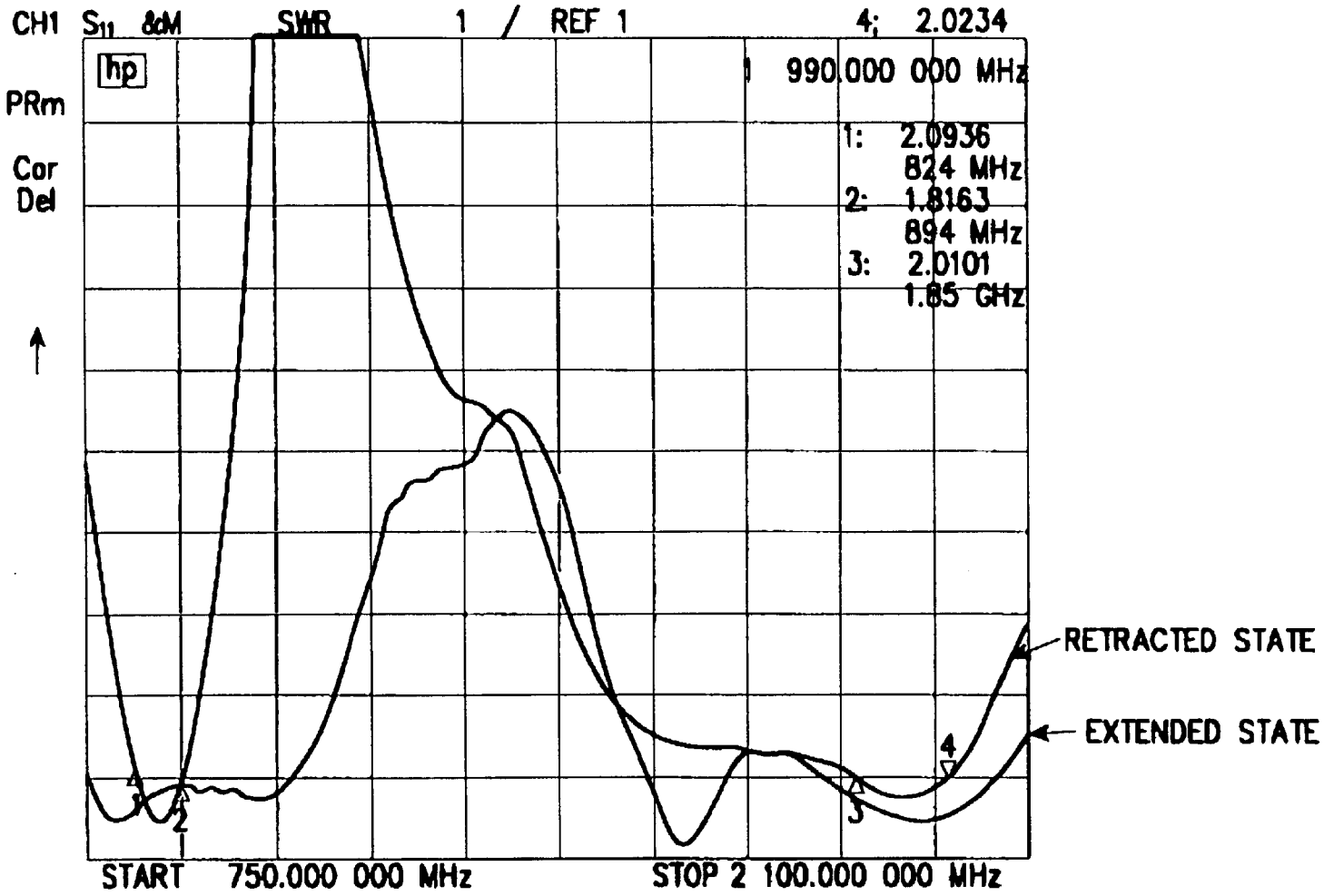
FIG. 9 is a diagram illustrating the impedance characteristic of the dual band antenna consisting of the whip antenna and the helical antenna.

FIG. 9 illustrates the impedance characteristics of the dual band antenna mounted on the radio terminal in both the extended state and the retracted state. It is noted that the dual band antenna shows the good matching characteristics at the AMPS (824–894 MHz) band and the US PCS (1850–1990 MHz) band.

Figure 10:
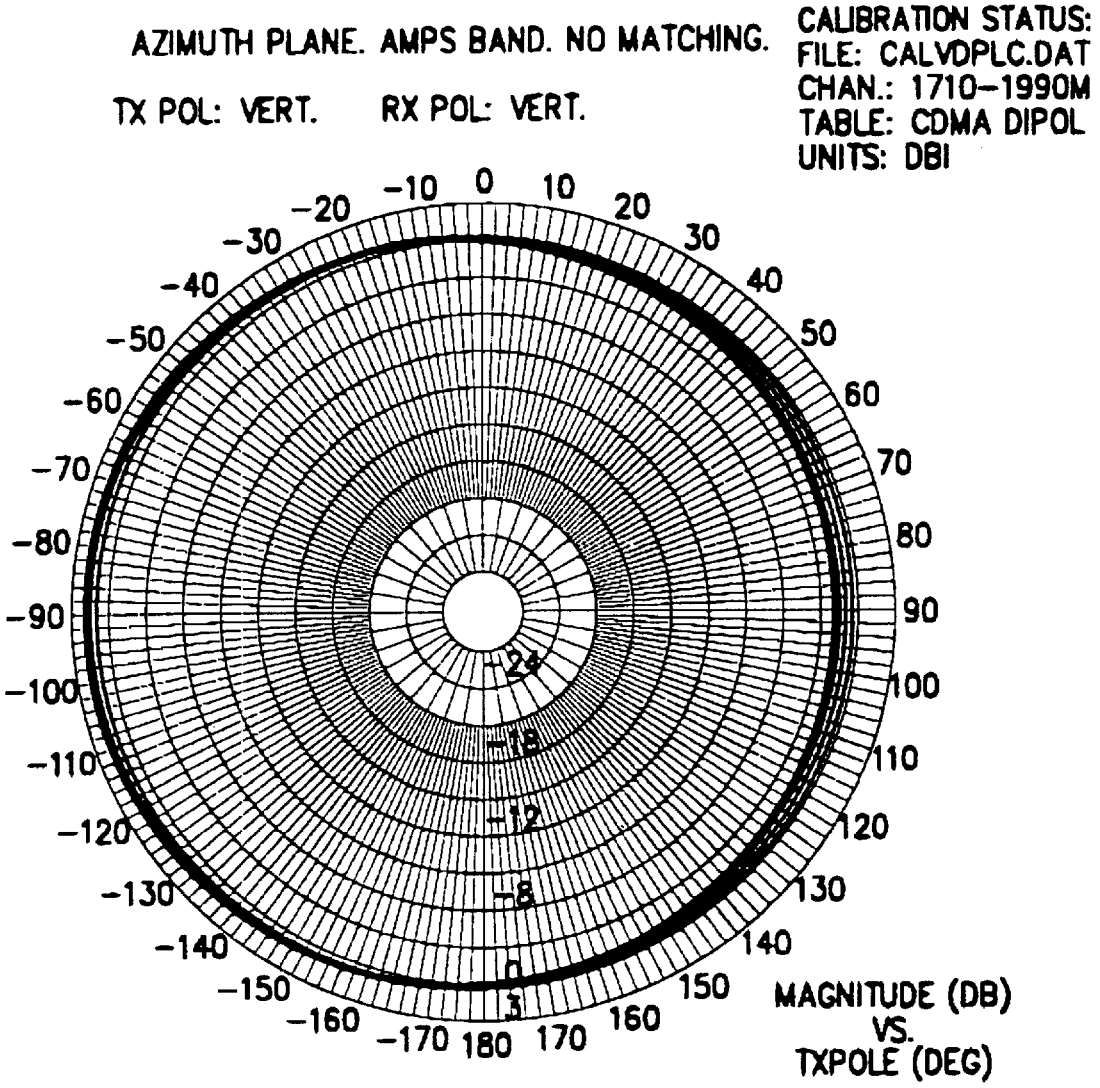
FIG. 10 is a diagram illustrating a radiation characteristic of the dual band antenna at an AMPS (Advanced Mobile Phone Service) band according to one embodiment of the present invention.
Figure 11:
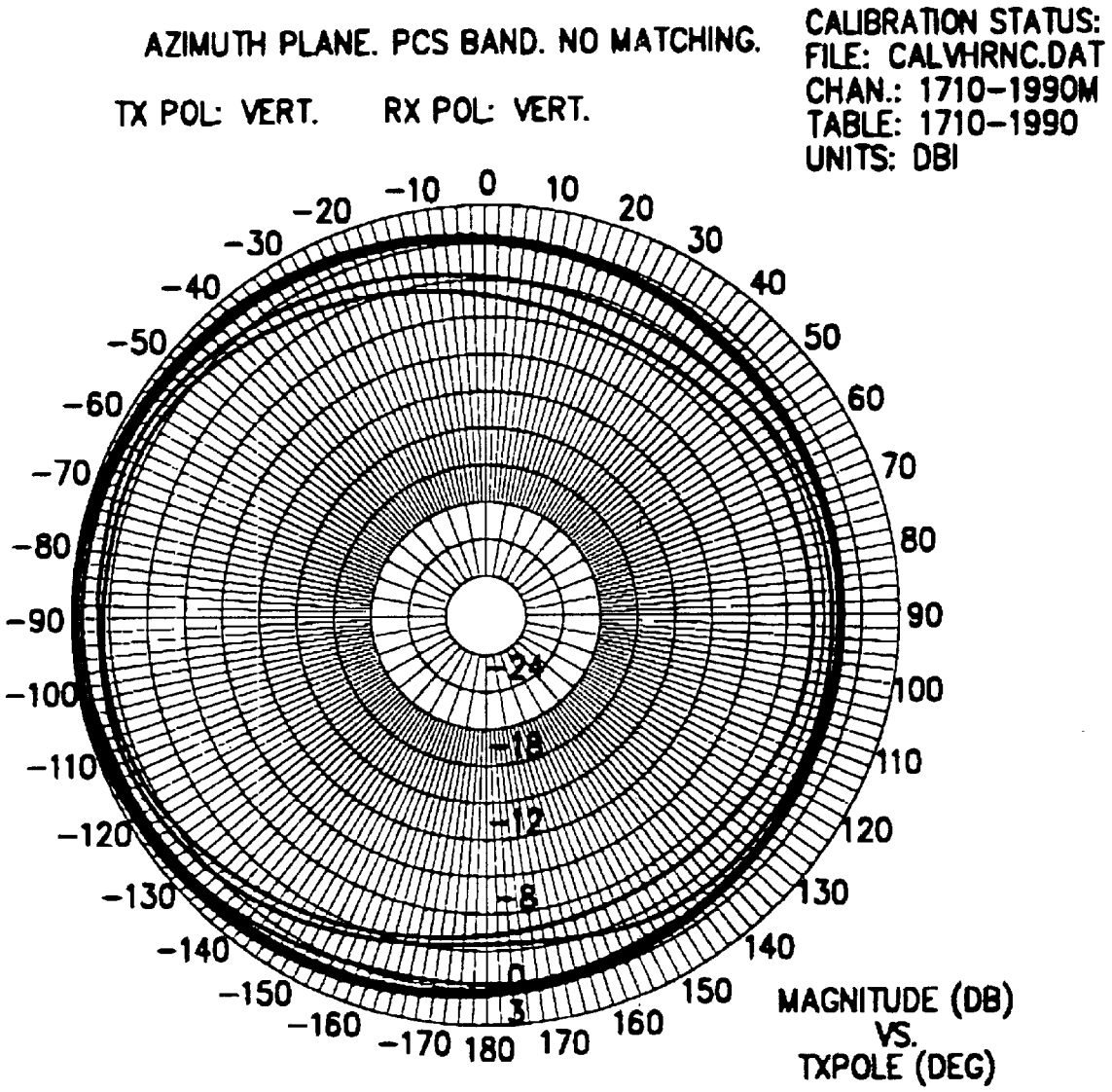
FIG. 11 is a diagram illustrating the radiation characteristic of the dual band antenna at a US PCS (Personal Communication Service) band according to one embodiment of the present invention.

FIG. 10 illustrates a radiation characteristic of the dual band antenna at the AMPS band, and FIG. 11 illustrates the radiation characteristic of the dual band antenna at the US PCS band according to one embodiment of the present invention.

Figure 12:
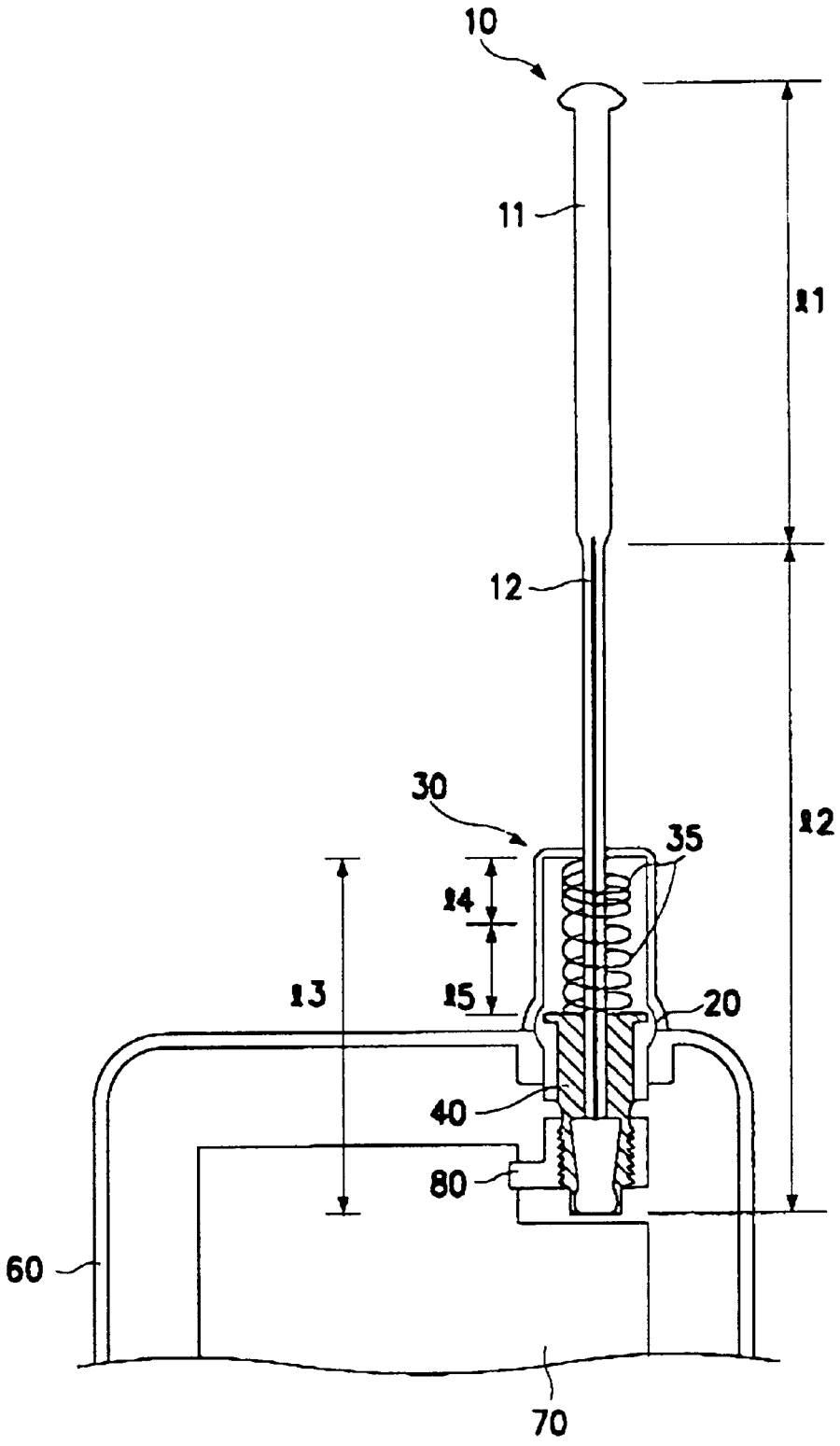
FIG. 12 is a cross sectional view illustrating a dual band antenna consisting of a retractable whip antenna and a helical antenna according to another embodiment of the present invention, wherein the whip antenna is extended from the radio terminal according to another embodiment of the present invention.

FIG. 12 illustrates a dual band antenna consisting of the retractable whip antenna 10 and the helical antenna 30 according to another embodiment of the present invention, wherein the whip antenna is extended from the radio terminal. As illustrated, the whip antenna 10 is in the form of a wire. In this embodiment, the dual band antenna is implemented using a periodic resonant characteristic of the whip antenna 10, without using the choke. Unlike the whip antenna shown in FIG. 2, the entire portion of the chokeless whip antenna operates at both the higher and lower frequency bands.

The whip antenna 10 is composed of a conductive core line 12 and an isolation element 11 extending from an upper end of the conductive core line 12. The helical antenna 30 has the same structure as that of FIG. 12.

In FIG. 12, reference l1 denotes a length of a portion of the isolation element 11, in which the conductive core line 12 does not exist. Reference l2 denotes a length of the conductive core line 12 of the whip antenna 10. Reference l3 denotes a physical length of the helical antenna 30 including the fixing element 40. References l4 and l5 denote physical lengths of the first and second helical portions of the helical antenna 30 having different pitches, respectively, wherein the first helical portion l4 has the narrower pitch than that of the second helical portion l5.

In order to realize the chokeless whip antenna, the resonant frequencies and the length of the whip antenna should be considered. Referring again to FIG. 4A, since the whip antenna 10 has a periodic resonant characteristic at a frequency ratio of 3:1, the length of the whip antenna 10 is properly determined such that one of the resonant frequencies is identical to one of the dual frequencies. Then, the antenna will resonate even at a frequency which is higher or lower than 3 times the selected frequency. In this ease, it is possible to shift the periodic resonant frequency to a desired frequency by using a matching circuit (not shown) at the prestage of the antenna. Further, the VSWR of the first selected resonant frequency is rarely affected. As described above, even though the frequency ratio of the dual band frequencies is not exactly 3;1, it is possible to use the whip antenna as a dual band antenna by using the matching circuit. The helical antenna 30 can also use the matching circuit prepared for the whip antenna 10 to implement the dual band antenna characteristic.

Figure 13:
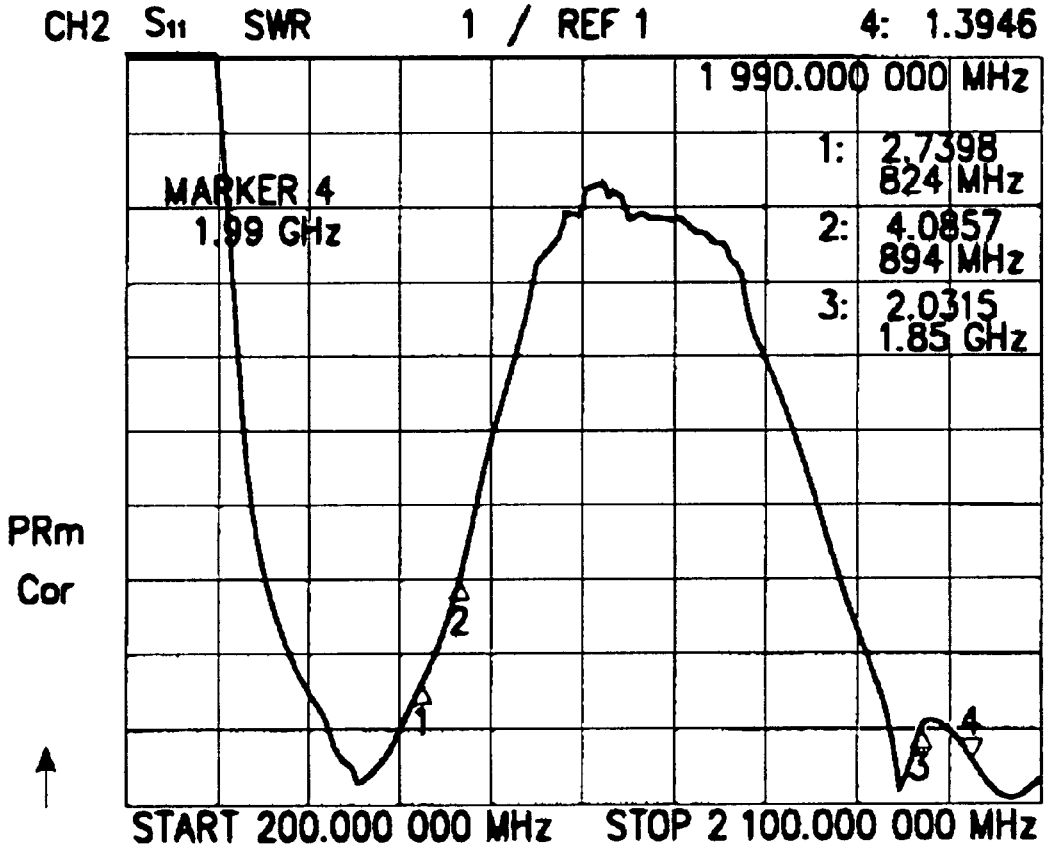
FIG. 13 is a diagram illustrating a VSWR (Voltage Standing Wave Ratio) of the whip antenna when the dual band antenna is not matched in an extended state according to another embodiment of the present invention.

FIG. 13 illustrates a VSWR of the whip antenna 10 when the dual band antenna is not matched in an extended state. By way of example, FIG. 13 shows the VSWR pattern in the event that the length of the whip antenna 10 is set to about $3\lambda/4$ of the PCS frequency band out of the AMPS/PCS dual bands.

Figure 14:
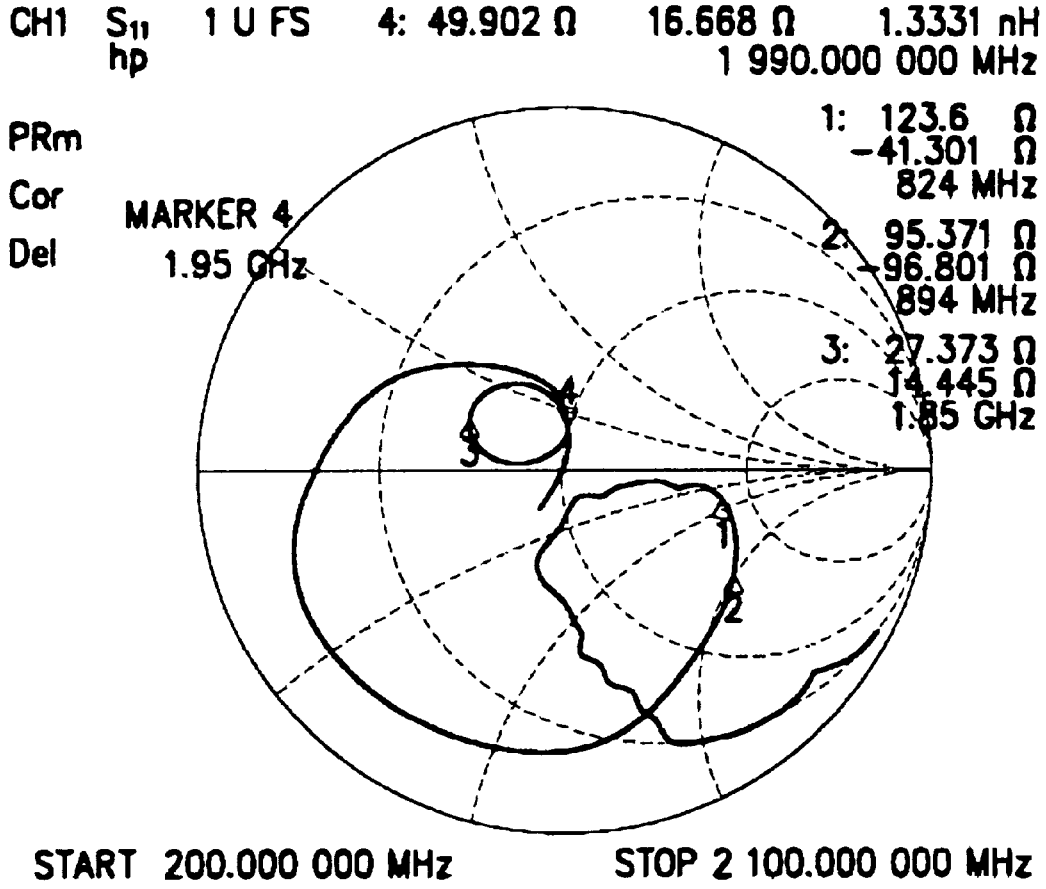
FIG. 14 is a Smith chart showing a reflection coefficient of the whip antenna when the dual band antenna is not matched in the extended state according to another embodiment of the present invention.
Figure 15:
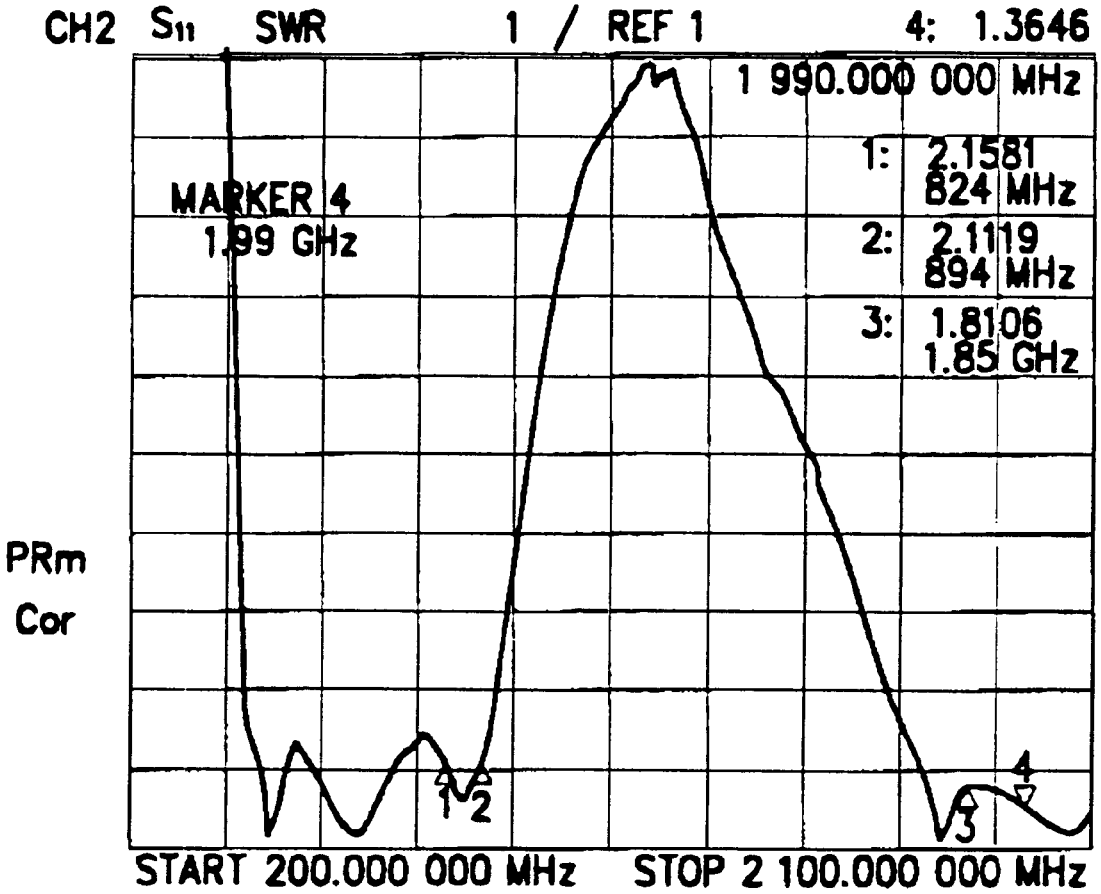
FIG. 15 is a diagram illustrating a VSVR of the whip antenna when the dual band antenna is matched in the extended state.
Figure 16:
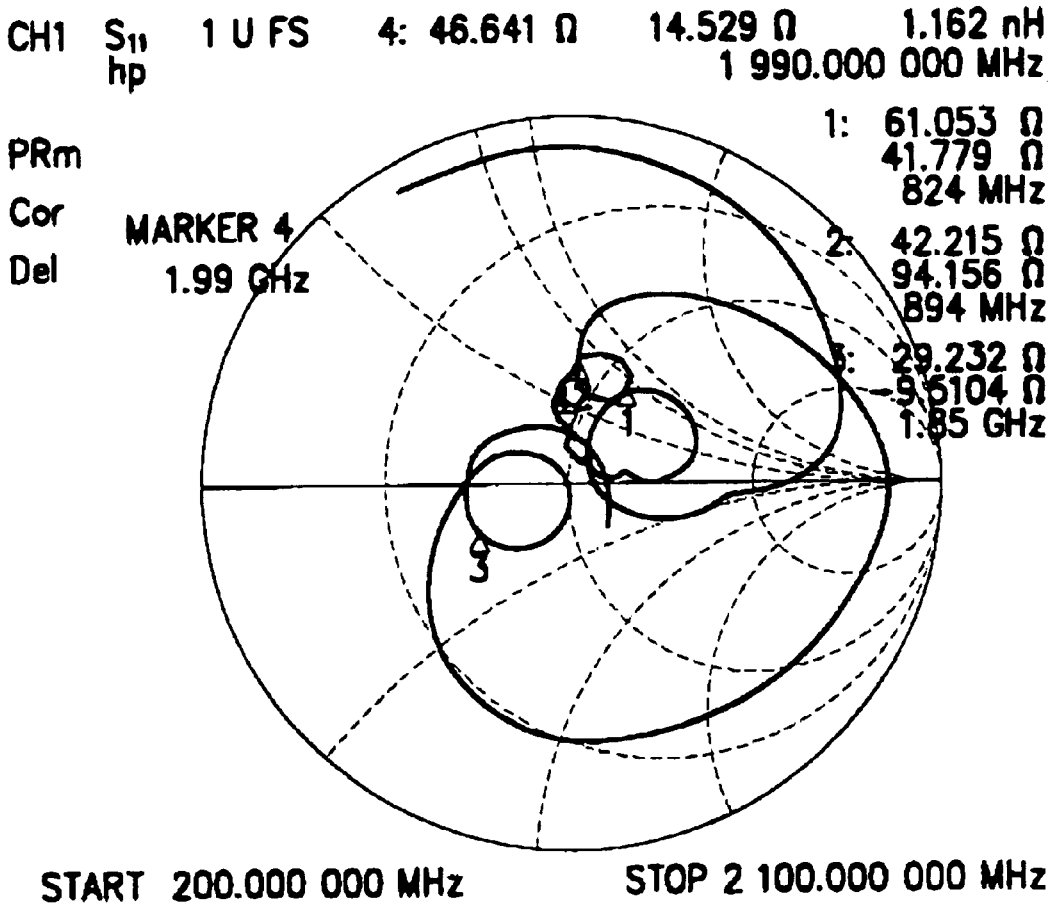
FIG. 16 is a Smith chart showing a reflection coefficient of the whip antenna when the dual band antenna is matched in the extended state.

FIG. 14 is a Smith chart showing a reflection coefficient of the whip antenna 10 when the dual band antenna is not matched in the extended state. FIG. 15 illustrates a VSWR of the whip antenna when the dual band antenna is matched in the extended state. FIG. 16 is a Smith chart showing a reflection coefficient of the whip antenna when the dual band antenna is matched in the extended state. It can be appreciated that the whip antenna 10 shows a desired resonant frequency characteristic at the PCS frequency band even without using a matching element, because it has the length such that resonation frequency, is generated at a frequency lower than the AMPS frequency band. In the embodiment, by providing a highpass matching circuit, only the lower resonant frequency is shifted to the AMPS frequency band without affecting the antenna impedance at the PCS frequency band, as shown in FIGS. 15 and 16. In FIGS. 13 and 15, markers 1 and 2 represent the AMPS frequency bands and markers 3 and 4 represent the PCS frequency bands. Additionally, according to the present invention, with the whip antenna in an extended state, an antenna impedance is introduced from the generation of parasitic elements of the helical antenna and the body. However, the impedance is of no consequence to the present invention.

Figure 17:
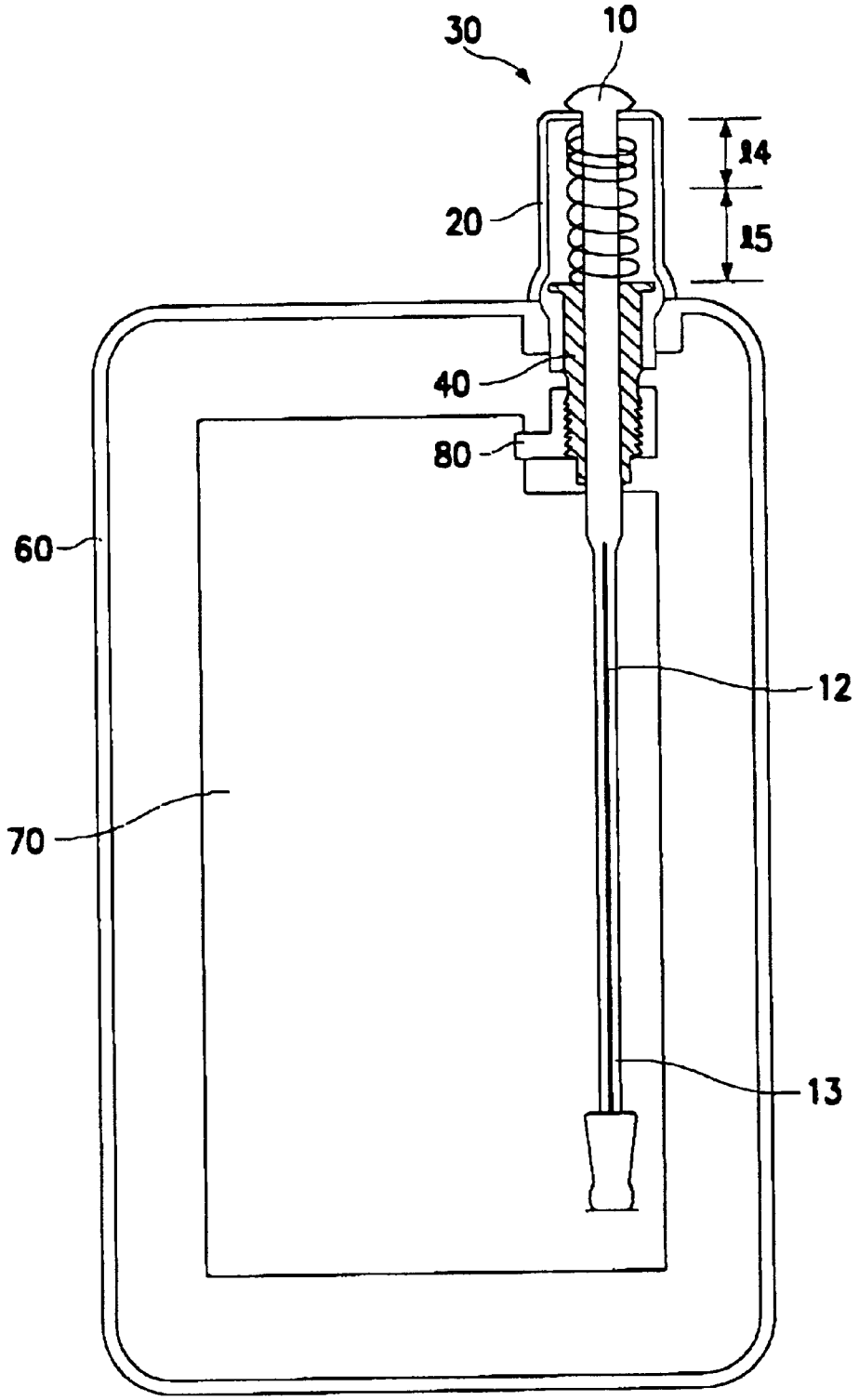
FIG. 17 is a cross sectional view illustrating the dual band antenna consisting of the retractable whip antenna and the helical antenna according to another embodiment of the present invention, wherein the whip antenna is retracted into the radio terminal.

FIG. 17 illustrates the dual band antenna consisting of the retractable whip antenna and the helical antenna according to another embodiment of the present invention, wherein the whip antenna is retracted into the radio terminal.

As described above, the dual band antenna is composed of a whip antenna and a helical antenna. The whip antenna is retractable when it is not in use, so that the radio terminal with the novel antenna is convenient to carry and not easily damaged by external impact. Further, it is possible to implement the dual band antenna by simply adjusting the pitch or the number of turns of the coil of the helical antenna, without using the separate matching circuit or the choke.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A dual band antenna for a radio terminal comprising:

a helical antenna including first and second helical portions, having first and second constant pitches, respectively, the first and second helical portions being independently operable at different frequency bands;

a whip antenna including a conductive core line, a conductive substance covering a first portion of the conductive core line to serve as a choke and an isolation element extending from an upper end of the conductive core line, for filling a gap between the conductive core line and the conductive substance, wherein only the first portion of the conductive core line is operable at a first frequency band and the entire conductive core line is operable at a second frequency band; and a fixing element for fixing the helical antenna and the whip antenna to a radio terminal, said fixing element having an upper end connected to a lower end of said helical antenna, said conductive substance extending from said lower end of said helical antenna to a point beyond said helical antenna when said whip antenna is in an extended position.

2. The dual band antenna as claimed in claim 1, wherein the fixing element has a through hole for inserting the whip antenna into an interior of the radio terminal.

3. The dual band antenna as claimed in claim 2, wherein the isolation element of the whip antenna is located in the through hole of the fixing element, when the whip antenna is retracted into the radio terminal, so as to decouple the whip antenna from the helical antenna.

4. The dual band antenna as claimed in claim 2, wherein the first frequency band is between 1850–1990 MHz and the second frequency band is between 824–894 MHz.

5. The dual band antenna as claimed in claim 1, wherein the whip antenna is retractable and extendable with respect to the radio terminal, such that only the helical antenna is operable when the whip antenna is retracted into the radio terminal.

6. The dual band antenna as claimed in claim 1, wherein the first pitch of the first helical portion is narrower than the second pitch of the second helical portion.

7. The dual band antenna as claimed in claim 1, wherein a ratio of the first frequency band to the second frequency band is controlled by adjusting the number of turns of a coil comprising said first and second helical portions.

8. The dual band antenna as claimed in claim 7, wherein the first and second pitches of the first and second helical portions are adjusted to control the ratio of the first frequency band to the second frequency band.

9. The dual band antenna as claimed in claim 1, wherein the fixing element has screwed teeth formed at a lower, outer wall for fixing the fixing element to the radio terminal .

10. A dual band antenna including a helical antenna for a radio terminal, comprising:

a whip antenna including a conductive core line, a conductive substance covering a first portion of the conductive core line to serve as a choke and an isolation element extending from an upper end of the conductive core line, for filling a gap between the conductive core line and the conductive substance, wherein only the first portion of the conductive core line is operable at a first frequency band and the entire conductive core line is operable at a second frequency band; and a fixing element for fixing the helical antenna and the whip antenna to the radio terminal, the fixing element having an upper end connected to a lower end of the helical antenna, said conductive substance extending from said lower end of the helical antenna to a point beyond the helical antenna when said whip antenna is in an extended position.

11. The dual band antenna as claimed in claim 10, wherein the isolation element of the whip antenna is located in the through hole of the fixing element, such that when the whip antenna is retracted into the radio terminal, the whip antenna is decoupled from the helical antenna.

12. The dual band antenna as claimed in claim 10, wherein the first frequency band is between 1850–1990 MHz and the second frequency band is between 824–894 MHz.

13. The dual band antenna as claimed in claim 10, wherein a length of the first portion of the whip antenna, covered with the conductive substance, is equal to a wavelength $\lambda/4$ at the first frequency band.

14. The dual band antenna as claimed in claim 10, wherein the fixing element has screwed teeth formed at a lower, outer wall for fixing the fixing element to the radio terminal.

15. A dual band antenna for a radio terminal, comprising:

a helical antenna including first and second helical portions having first and second constant pitches, respectively, the first and second helical portions being independently operable at different frequency bands;

a whip antenna including a conductive core line, a conductive substance covering a first portion of the conductive core line to serve as a choke and an isolation element extending from an upper end of the conductive core line, for filling a gap between the conductive core line and the conductive substance; and a fixing element for fixing the helical antenna and the whip antenna to the radio terminal, said fixing element having an upper end connected to a lower end of said helical antenna, said conductive substance extending from said lower end of said helical antenna to a point beyond the helical antenna when said whip antenna is in an extended position.

16. The dual band antenna as claimed in claim 15, wherein the first pitch is narrower than the second pitch.

17. The dual band antenna as claimed in claim 15, wherein the first helical portion is operable at a first frequency band between 1850–1990 MHz and the second helical portion is operable at a second frequency band between 824–894 MHz.

18. The dual band antenna as claimed in claim 17, wherein a ratio of the first frequency band to the second frequency band is controlled by adjusting the number of turns of a coil constituting the helical antenna.

19. The dual band antenna as claimed in claim 18, wherein the first and second pitches of the first and second helical portions may also be adjusted to control the ratio of the first and second frequency bands.

20. The dual band antenna as claimed in claim 15, further comprising an isolation tube for protecting the helical antenna.

21. The dual band antenna as claimed in claim 15, wherein the fixing element has screwed teeth formed at a lower, outer wall for fixing the fixing element to the radio terminal.

22. A dual band antenna for a radio terminal, comprising:

a helical antenna including first and second helical portions having first and second constant pitches, respectively, the first and second helical portions being operable at different frequency bands;

a whip antenna including a conductive core line, a conductive substance covering a first portion of the conductive core line and an isolation element extending from an upper end of the conductive core line, wherein the whip antenna is operable at the two different frequency bands using a periodic resonant frequency thereof; and a fixing element for fixing the helical antenna and the whip antenna to the radio terminal, wherein the fixing element has an upper end connected to a lower end of the helical antenna and a through hole via which the whip antenna is inserted into an interior of the radio terminal, said conductive substance extending from said lower end of said helical antenna to a point beyond the helical antenna when said whip antenna is in an extended position.

23. The dual band antenna as claimed in claim 22, wherein the whip antenna has a length determined such that one of resonant frequencies detected by the periodic resonant characteristic of the whip antenna is identical to one of the two frequency bands.

24. The dual band antenna as claimed in claim 22, further comprising a matching circuit for adjusting the resonant frequency of the whip antenna.

25. The dual band antenna as claimed in claim 22, wherein the whip antenna is retractable and extendable with respect to the radio terminal, such that only the helical antenna is operable when the whip antenna is retracted into the radio terminal.

26. The dual band antenna as claimed in claim 22, wherein the first pitch of the first helical portion is narrower than the second pitch of the second helical portion.

27. The dual band antenna as claimed in claim 22, wherein the isolation element of the whip antenna is located in the through hole of the fixing element, when the whip antenna is retracted into the radio terminal so as to decouple the whip antenna from the helical antenna.

28. The dual band antenna as claimed in claim 22, wherein a ratio of a first frequency band to a second frequency band is controlled by adjusting the number of turns of a coil constituting the helical antenna, adjusting the first and second pitches of the first and second helical portions.

29. The dual band antenna as claimed in claim 22, wherein an impedance characteristic of the helical antenna is identical to an impedance characteristic of the whip antenna, so that the whip antenna can shore the matching circuit with the helical antenna.

* * * * *